US007825872B2

(12) United States Patent
Guo

(10) Patent No.: US 7,825,872 B2
(45) Date of Patent: Nov. 2, 2010

(54) LOCKING MECHANISM FOR ANTENNA OF ELECTRONIC APPARATUS

(75) Inventor: Shi-Kun Guo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 365 days.

(21) Appl. No.: 12/143,843

(22) Filed: Jun. 23, 2008

(65) Prior Publication Data

US 2009/0135083 A1 May 28, 2009

(30) Foreign Application Priority Data

Nov. 23, 2007 (CN) ..... 2007 1 0202650

(51) Int. Cl.
*H01Q 1/12* (2006.01)

(52) U.S. Cl. ..... 343/880; 343/702; 343/881; 343/883; 343/901

(58) Field of Classification Search ..... 343/702, 343/880, 881, 883, 901, 903
See application file for complete search history.

(56) References Cited

U.S. PATENT DOCUMENTS 5,959,593 A * 9/1999 Hoshi ..... 343/903
6,298,662 B1 * 10/2001 Vezain et al. ..... 60/527
6,353,733 B1 * 3/2002 Murray et al. ..... 455/90.1
6,573,868 B2 * 6/2003 Johnson et al. ..... 343/702

* cited by examiner

*Primary Examiner*—Douglas W Owens
*Assistant Examiner*—Chuc D Tran
(74) *Attorney, Agent, or Firm*—Frank R. Niranjan

(57) ABSTRACT

An electronic apparatus (10) includes an enclosure (30), an antenna (20) and a locking mechanism (40). The antenna has a mount end (24) and an opposite free end (22). The mount end is pivotably mounted to the enclosure. The free end defines an engaging groove (220) therein. The locking mechanism includes a hook (50) for being engaged in the engaging groove of the antenna, a resilient mount (60) connected with the hook and capable of rotating with the hook, a supporting unit (80) for mounting the resilient mount to the enclosure, and a elastic member (70) for providing a resilient force when the hook and the resilient mount rotates.

17 Claims, 10 Drawing Sheets

LOCKING MECHANISM FOR ANTENNA OF ELECTRONIC APPARATUS

BACKGROUND

1. Field of the Invention

The present invention generally relates to electronic apparatuses, and particularly to a locking mechanism, which can fixedly clip an antenna onto an electronic apparatus.

2. Description of Related Art

Antennas are commonly used in electronic apparatuses for sending and receiving signals. A typical antenna includes a mounting end and a free end opposite to the mounted end. The mounted end is mounted and attached to the enclosure of the electronic apparatus. The enclosure has an engaging block with a U-shaped cutout. The U-shaped cutout is for receiving the free end of the antenna therein. The width of a top open end of the cutout is smaller than the diameter of the free end of the antenna, while a closed bottom end of the cutout is equal to or larger than the diameter of the free end of the antenna. When the antenna is to be placed in the cutout, a force is applied on the free end of the antenna for forcing the free end of the antenna to snap into the cutout. Because the width of the open end of the cutout is smaller than the diameter of the free end of the antenna, the top end of the engaging block instantaneously deforms outwards when the free end of the antenna snaps through the open end of the cutout. When the free end of the antenna has passed through the open end of the cutout, the top end of the engaging block is restored to its original state and the free end of the antenna is therefore secure in place by the engaging block.

However, the engaging block is usually made of plastic which deteriorates after a period of time and the resiliency and deformation capability will, accordingly, be reduced. This may result in the antenna not being securely fixed to the enclosure and may disengage from the engaging block.

What is needed, therefore, is a locking mechanism for reliable securing the free end of clamping an antenna onto an electronic apparatus for an extended period of time.

SUMMARY

The present invention relates to a locking mechanism for clamping an antenna of an electronic apparatus. According to an exemplary embodiment of the present invention, the electronic apparatus includes an enclosure, an antenna and a locking mechanism. The antenna has a mount end and an opposite free end. The mount end is pivotably mounted to the enclosure. The free end defines an engaging groove therein. The locking mechanism includes a hook for being engaged in the engaging groove of the antenna, a resilient mount connected with the hook and capable of rotating with the hook, a supporting unit for mounting the resilient mount to the enclosure, and an elastic member for providing a resilient force when the hook and the resilient mount rotates.

Other advantages and novel features of the present invention will become more apparent from the following detailed description of an embodiment/embodiments when taken in conjunction with the accompanying drawings.

DETAILED DESCRIPTION

Figure 1:
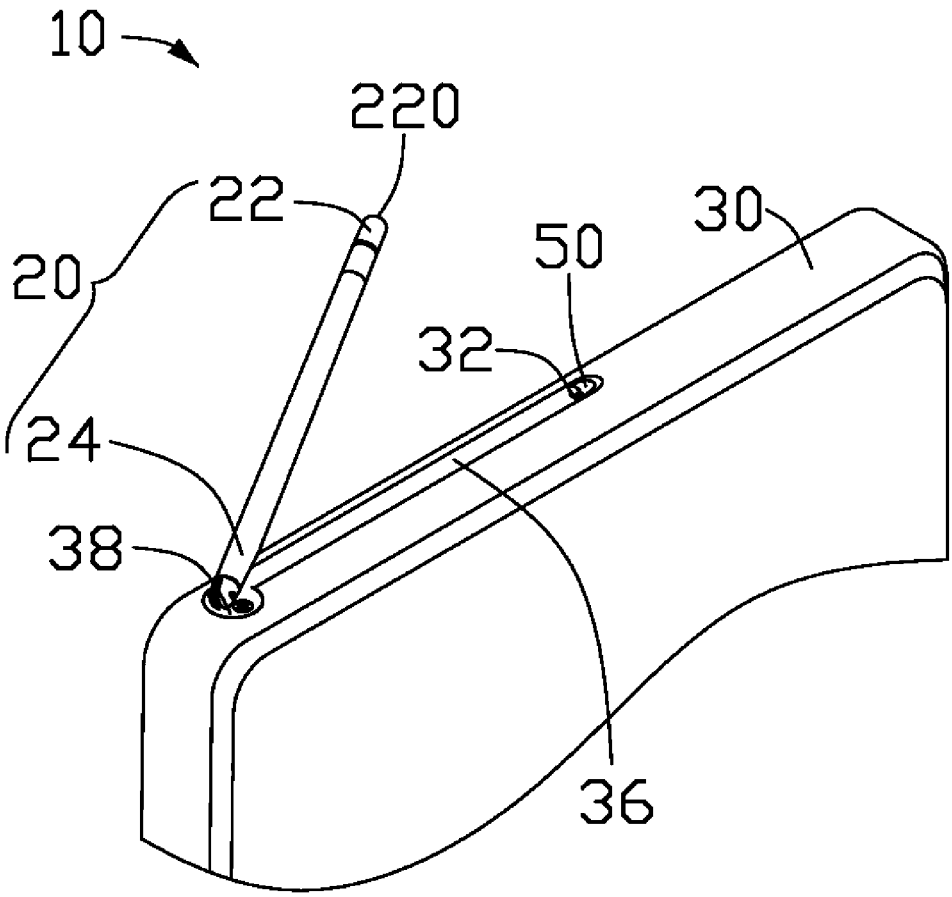
FIG. 1 an assembled, isometric view of an electronic apparatus in accordance with an exemplary embodiment of the present invention.

Reference will now be made to the drawing figures to describe the various present embodiments in detail.

Figure 2:
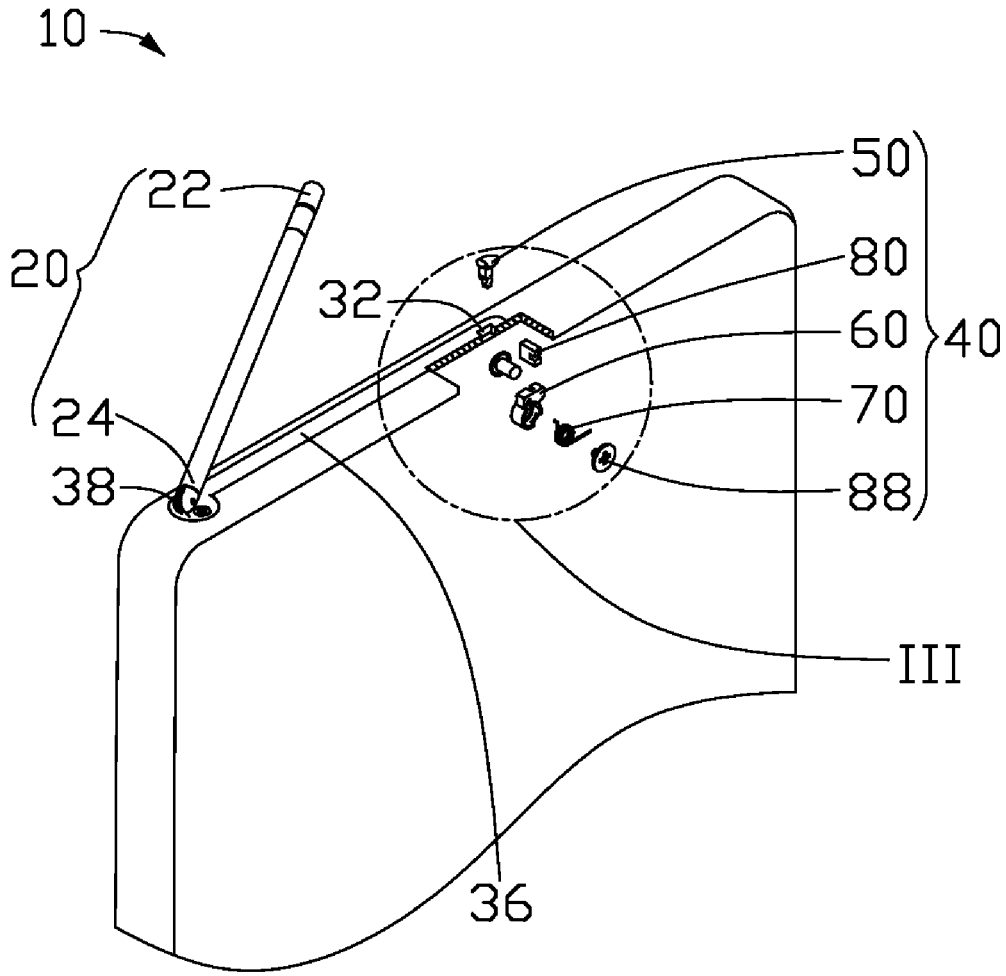
FIG. 2 is an exploded, isometric view of the electronic apparatus of FIG. 1, with a cover of an enclosure of the electronic apparatus being removed.

Referring to FIGS. 1 and 2, an electronic apparatus 10 in accordance with an exemplary embodiment of the present invention is shown. The electronic apparatus 10 has an enclosure 30 and an antenna 20 pivotably mounted to the enclosure 30. An elongated receiving groove 36 is defined in one side of the enclosure 30 for receiving the antenna 20. A mounting element 38 is disposed at one end of the receiving groove 36 for attaching a mounting end 24, of the antenna 20, to the enclosure 30 of the electronic apparatus 10. A slot 32 is defined in the other end of the receiving groove 36. A locking mechanism 40 is disposed at the other end of the receiving groove 36, for locking a free end 22 of the antenna 20 thereby preventing the free end 22 from disengaging from the receiving groove 36. An engaging groove 220 is defined in a distal surface of the free end 22 of the antenna 20.

Figure 3:
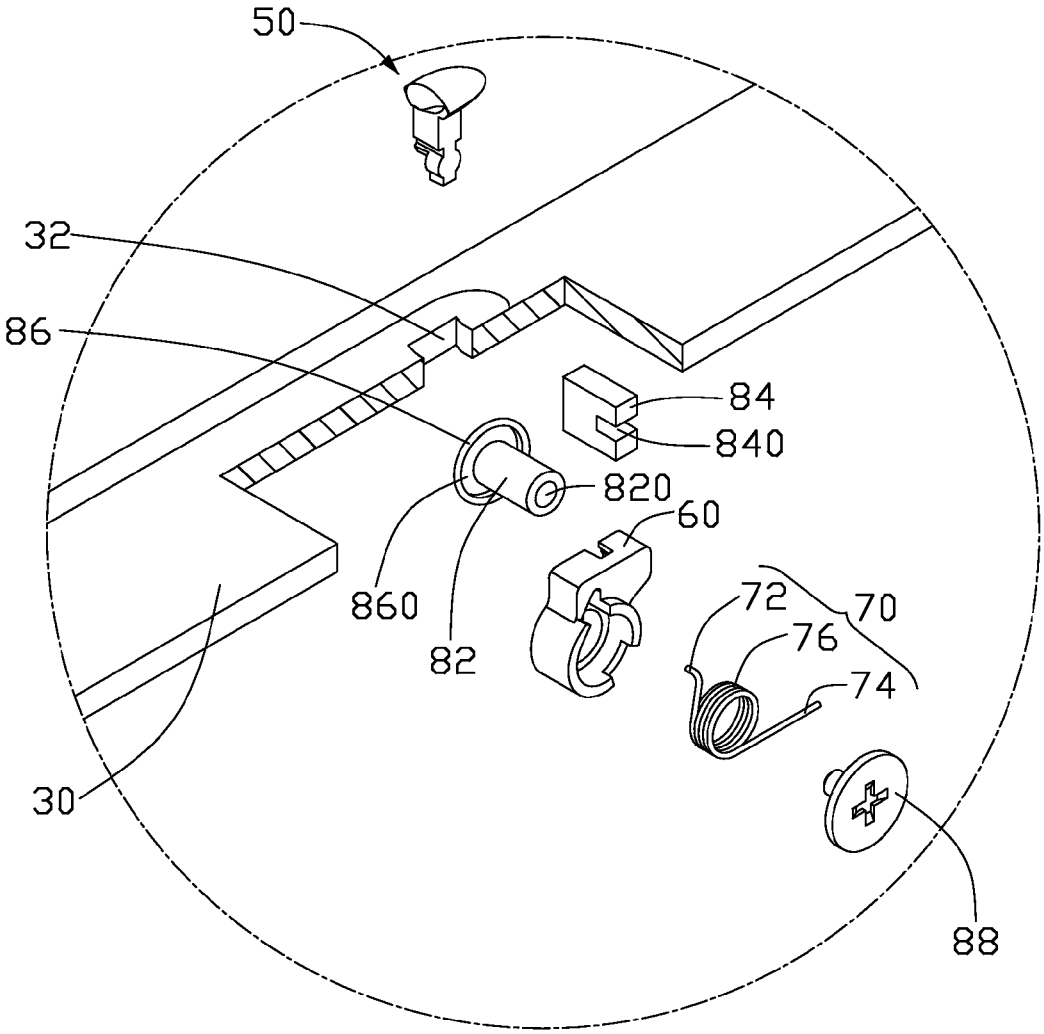
FIG. 3 is an enlarged view of a circled portion III of the electronic apparatus of FIG. 2.
Figure 4:
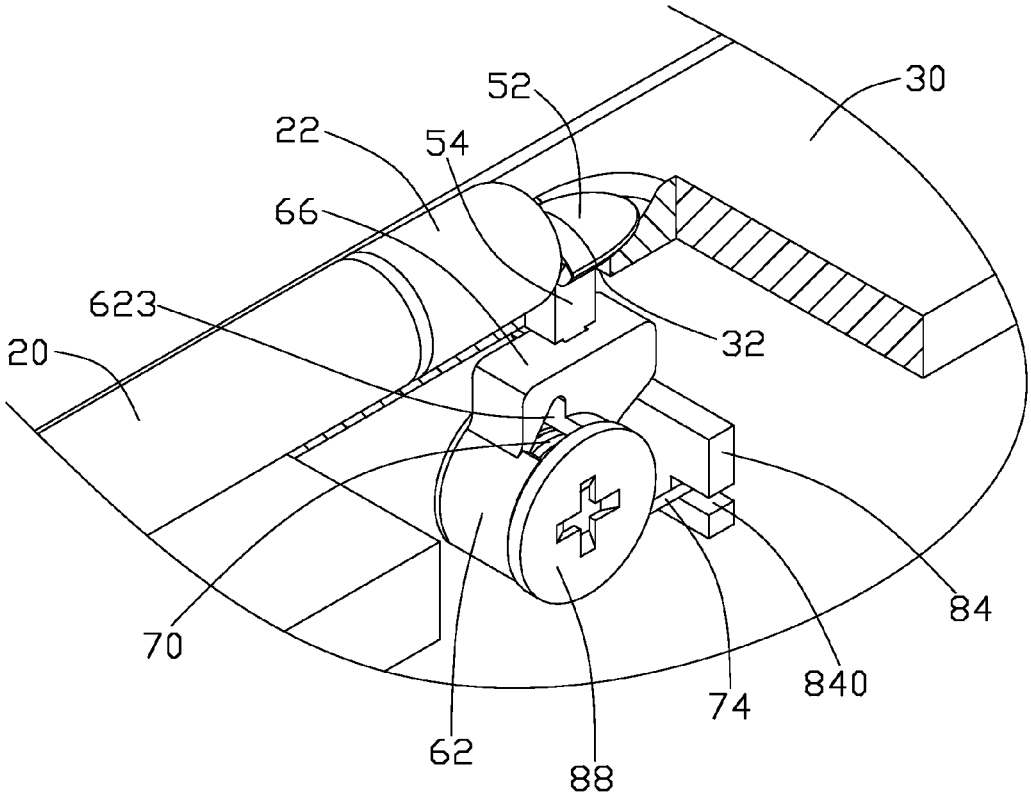
FIG. 4 is an assembled view of FIG. 3, with a part of a top surface of the enclosure being cut away.

Also referring to FIGS. 3 and 4, the locking mechanism 40 includes a supporting unit 80, a resilient mount 60, an elastic member such as a coil spring 70, a hook 50, and a screw 88.

The supporting unit 80 is firmly secured to the enclosure 30. The supporting unit 80 includes a cylindrical pivot shaft 82, an annular flange 86 and a clasping block 84. The pivot shaft 82, the flange 86 and the clasping block 84 are integrally formed with the enclosure 30 from a single piece, respectively and space from each other. A threaded hole 820 is defined in the pivot shaft 82 for engaging the screw 88 therein. The flange 86 is located around the pivot shaft 82, thereby forming an annular space 860 between an outer surface of the pivot shaft 82 and an inner surface of the flange 86. The clasping block 84 is separated from and located besides the pivot shaft 82 and the flange 86. A cutout 840 is defined through a top end of the clasping block 84.

The coil spring 70 is received in the resilient mount 60. The coil spring 70 has a first end 72, a second end 74 opposite to the first end 72, and a coil 76 is disposed between the first end 72 and the second end 74. The first end 72 is configured to be L-shaped and is fixed to the resilient mount 60. The coil 76 is received in the resilient mount 60 and sleeved on the pivot shaft 82. The second end 74 has a linear configuration and is received in the cutout 840 of the clasping block 84.

Figure 5:
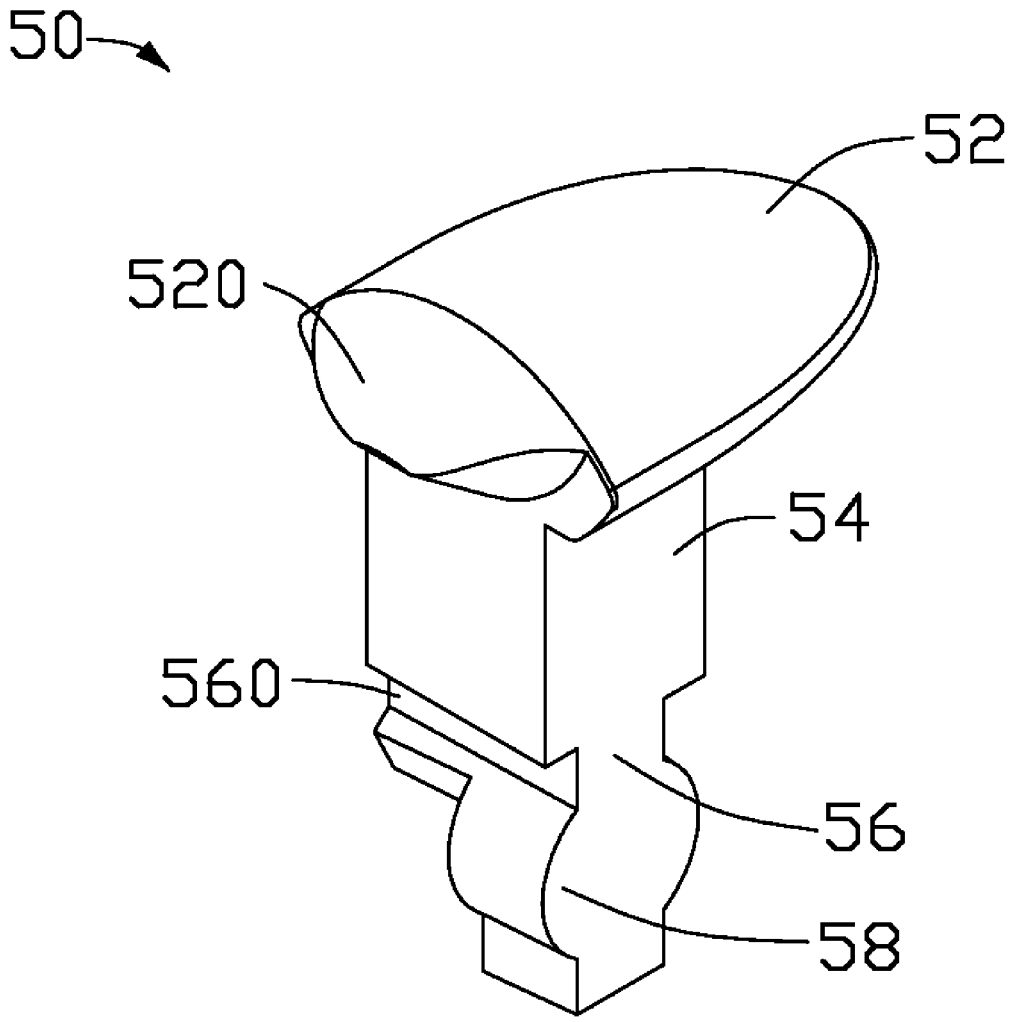
FIG. 5 is an isometric view of a hook of the locking mechanism of FIG. 3.
Figure 6:
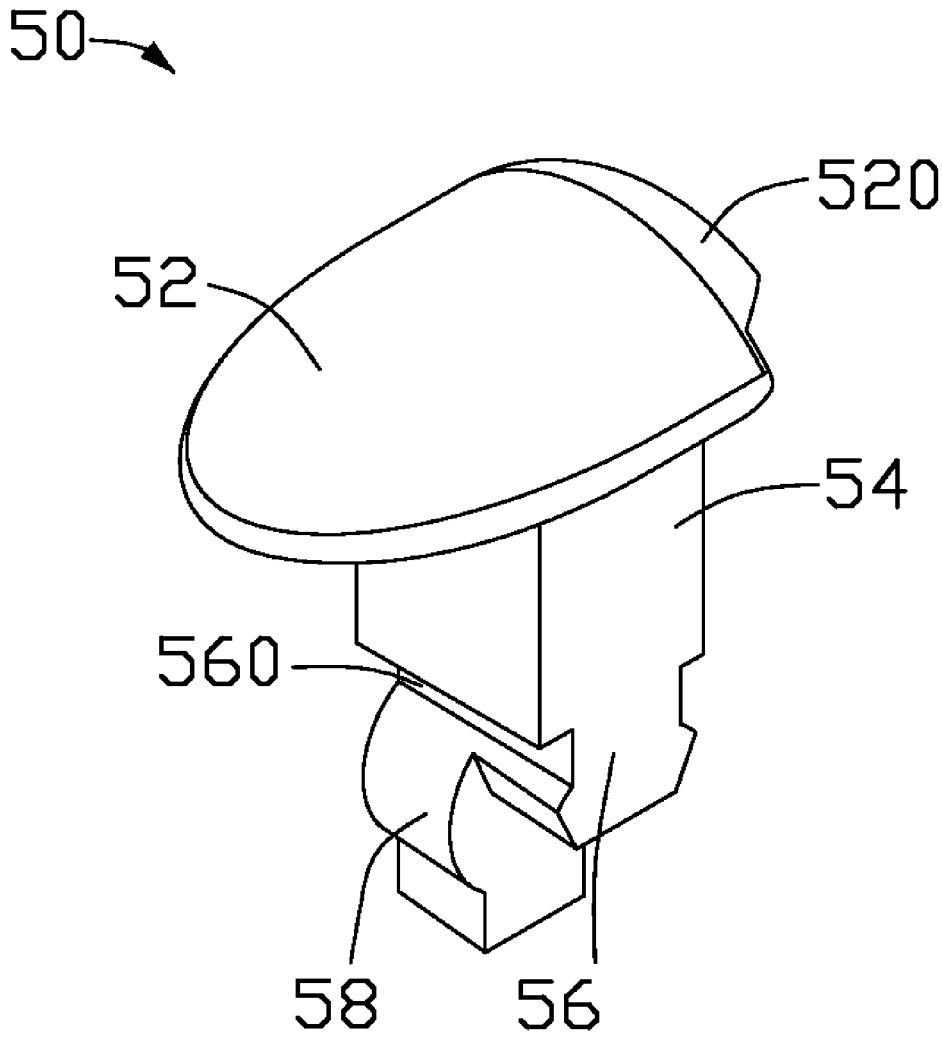
FIG. 6 is similar to FIG. 5 but viewed from a right-to-left aspect.

Referring to FIGS. 5 and 6, the hook 50 has a hatchet-shaped configuration, and includes a head 52, a neck 54, a body 56 and a tail 58. The head 52, the neck 54, the body 56 and the tail 58 are integrally formed from a single piece. The head 52 passes through the slot 32 defined in the enclosure 30 and is exposed outside of the enclosure 30. The head 52 has a wedge 520 formed at a side adjacent the free end 22 of the antenna 20 when the antenna 20 is locked. The wedge 520 of the hook 50 receives the engaging groove 220 defined in the free end 22 of the antenna 20 to secure the antenna 20 in the receiving groove 36 of the enclosure 30. The neck 54 of the hook 50 is positioned in the slot 32 of the enclosure 30. A size of the neck 54 is smaller than a size of the slot 32 so that the hook 50 can move back and forth in the slot 32. The body 56 and the tail 58 are fixed to the resilient mount 60 so that the resilient mount 60 can rotate together with the hook 50 with respect to the pivot shaft 82. The tail 58 has two opposite side surfaces which have arched configurations. A width of the body 56 is smaller than a largest width of the tail 58, and smaller than a width of the neck 54. Two indents 560 are formed at opposite sides of the body 56 and between the neck 54 and the tail 58.

Figure 7:
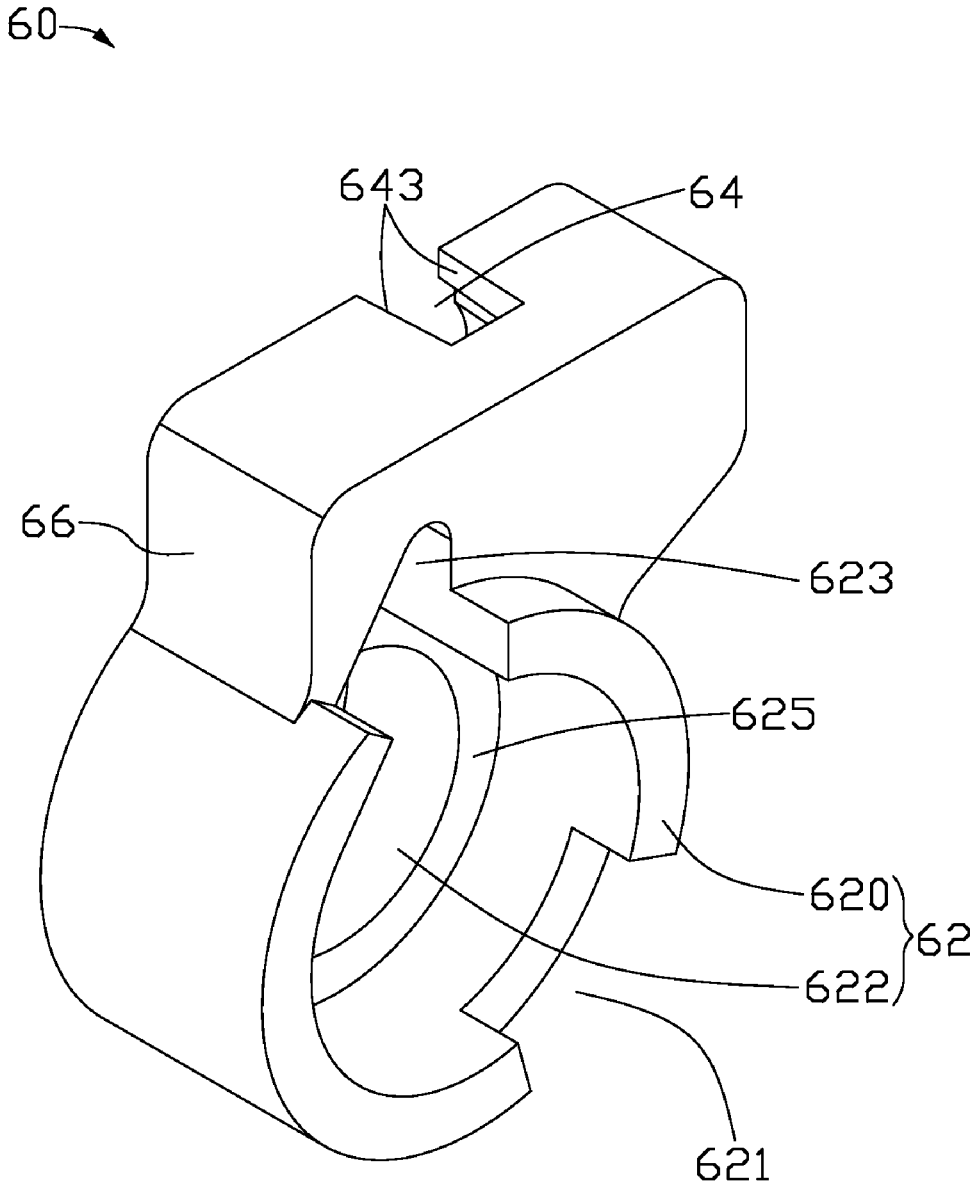
FIG. 7 is an isometric view of a resilient mount of the locking mechanism of FIG. 3.
Figure 8:
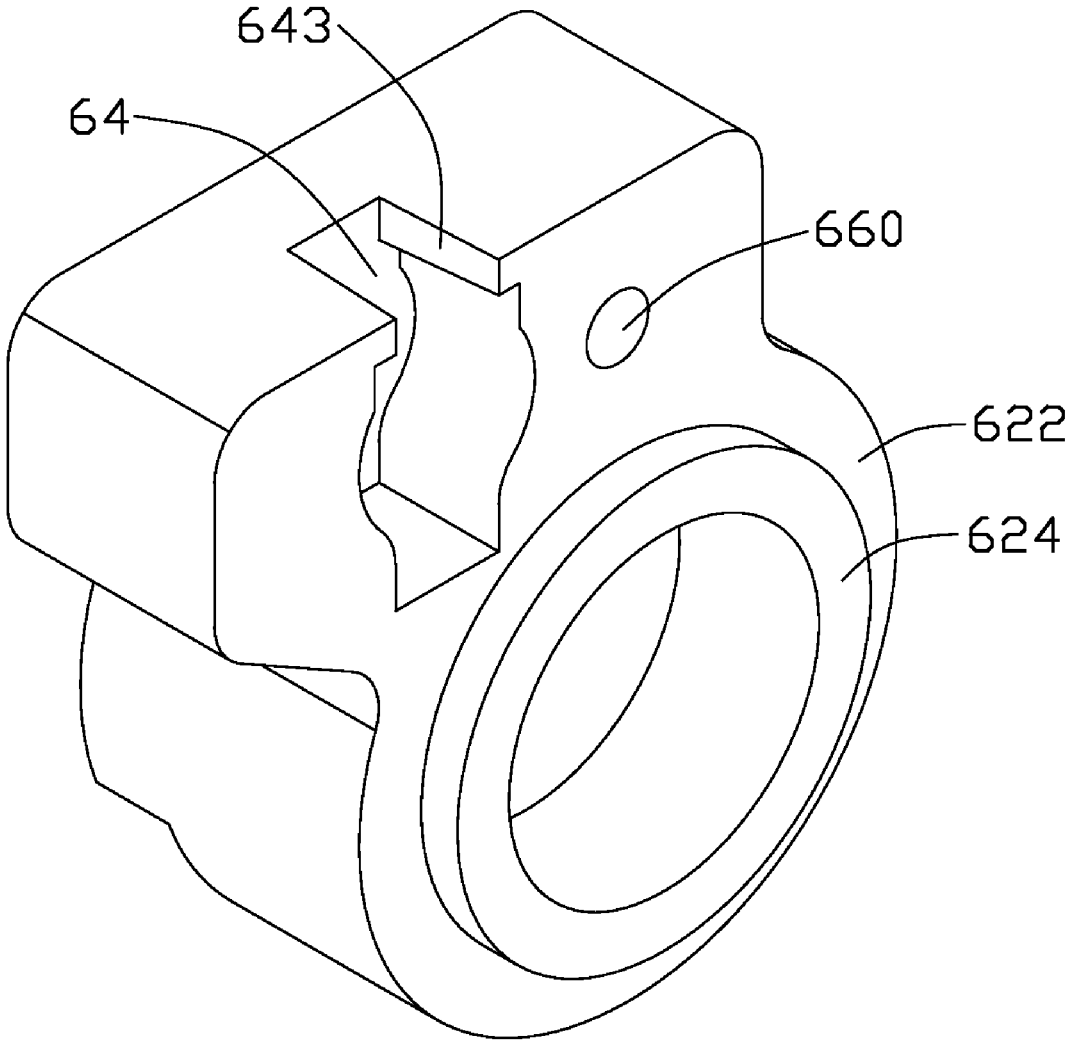
FIG. 8 is similar to FIG. 7 but viewed from a rear-to-front aspect.

Referring to FIGS. 7 and 8, the resilient mount 60 includes a main body 62, and a tab 66 integrally extending from the main body 62. The main body 62 is pivotably mounted around the pivot shaft 82 of the supporting unit 80. The tab 66 is connected with the body 56 and the tail 58 of the hook 50.

The main body 62 of the resilient mount 60 includes a tubular upper portion 620 and a tubular lower portion 622 integrally connected with the upper portion 620. A diameter of an inner surface of the lower portion 622 is smaller than a diameter of an inner surface of the upper portion 620. An abutting surface 625 is formed between the upper portion 620 and the lower portion 622. An annular brim 624 protrudes from a bottom surface of the lower portion 622 of the main body 62, for being received in the annular space 860 formed between the flange 86 and the pivot shaft 82 of the supporting unit 80. The upper portion 620 of the main body 62 receives the coil 76 of the coil spring 70 therein. The resilient mount 60 defines a substantially triangular first aperture 623 and an arched second aperture 621 in a front side thereof. The first aperture 623 axially extends through the upper portion 620 of the main body 62 and radially extends into the tab 66. The second aperture 621 only axially extends through a top end of the upper portion 620 of the main body 62. A hole 660 is defined in the tab 66 of the resilient mount 60 and communicates with the first aperture 623. The first end 72 of the coil spring 70 is received in the first aperture 623 and passes through the hole 660 so as to fix the first end 72 of the coil spring 70.

The tab 66 defines a receiving cavity 64 in a bottom side of a top portion thereof, for receiving the body 56 and the tail 58 of the hook 50 therein. The size and shape of the receiving cavity 64 is substantially the same as the size and shape of the tail 58 of the hook 50. The receiving cavity 64 has two projections 643 located at a top end thereof. When the tail 58 of the hook 50 is received in the receiving cavity 64 of the tab 66, the projections 643 laterally extend into the indents 560 of the hook 50 and engage with the tail 58 of the hook 50, thereby preventing the tail 58 of the hook 50 from disengaging from the receiving cavity 64 of the resilient mount 60.

Figure 9:
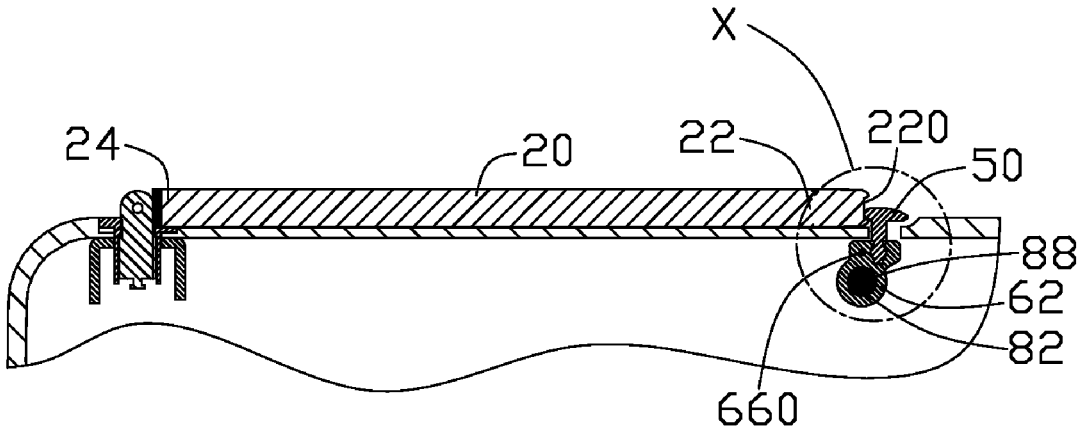
FIG. 9 is a cross-sectional view of the electronic apparatus of FIG. 1 at a state when an antenna is received in a receiving groove of the enclosure of the electronic apparatus.
Figure 10:
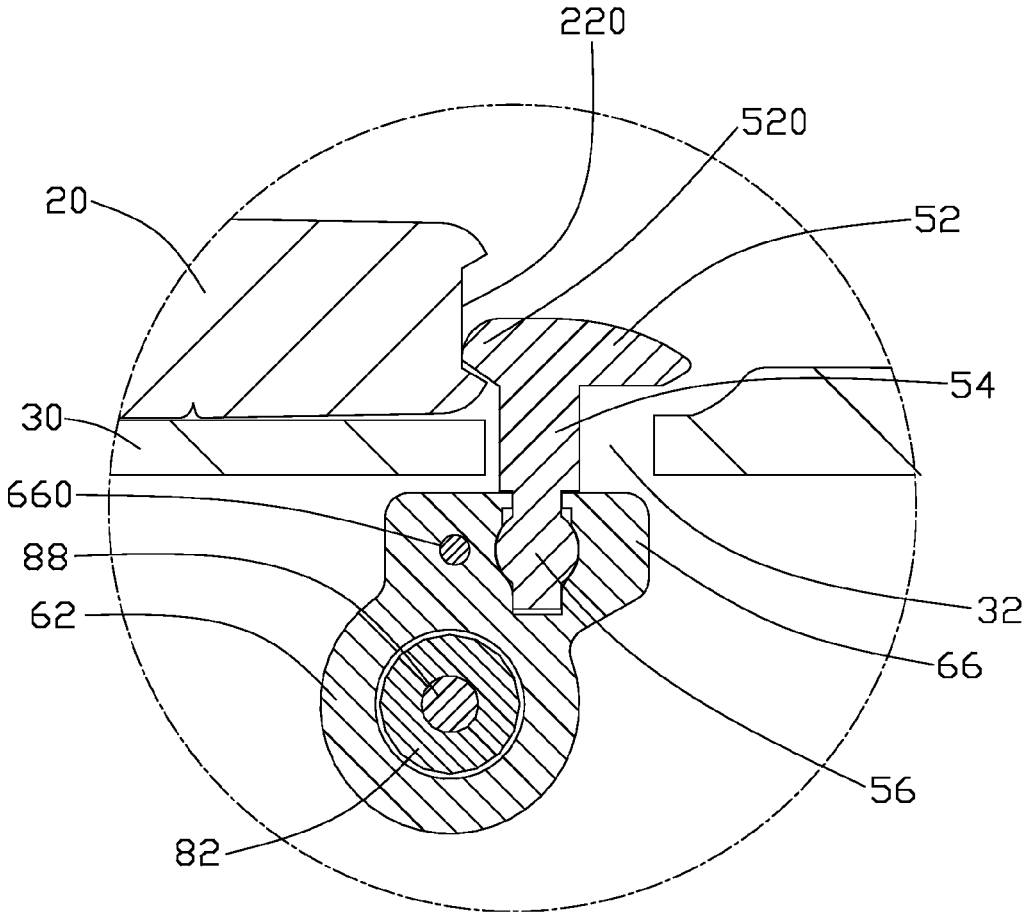
FIG. 10 is an enlarged view of a circled portion X of FIG. 9.

Referring to FIGS. 4, 9 and 10, in assembly of the locking mechanism 40 to the electronic apparatus 10, the body 56 and the tail 58 of the hook 50 pass through the slot 32 of the enclosure 30. Meanwhile, the head 52 of the hook 50 is exposed outside of the enclosure 30 and the neck 54 of the hook 50 is received in the slot 32. The resilient mount 60 is placed onto the pivot shaft 82 of the supporting unit 80 with the pivot shaft 82 passing through the upper and the lower portions 620, 622. Under this state, the brim 624 of the resilient mount 60 is received in the annular space 860 between the pivot shaft 82 and the flange 86. The neck 54 and the tail 58 of the hook 50 are received in the receiving cavity 64 of the resilient mount 60.

The coil spring 70 is placed in the resilient mount 60, with the coil 76 of the coil spring 70 being received in a space formed between the pivot shaft 82 and the inner surface of the upper portion 620, and abutting against the abutting surface 625 between the upper and the lower portions 620, 622. The first end 72 of the coil spring 70 is received in the first aperture 623 and engaged in the hole 660 of the tab 66. The second end 74 of the coil spring 70 passes through the second aperture 621 of the resilient mount 60 and engages in the cutout 840 of the clasping block 84 of the supporting unit 80. The screw 88 is screwed in the threaded hole 820 of the pivot shaft 82 and the locking mechanism 40 is therefore mounted to the enclosure 30 of the electronic apparatus 10. A diameter of a head portion of the screw 88 is greater than a diameter of the inner surface of the upper portion 620 of the resilient mount 60, so that the head portion of the screw 88 can prevent the resilient mount 60 from being disengaged from the pivot shaft 82 during rotation of the resilient mount 60.

In operation of the locking mechanism 40, when the antenna 20 is pressed toward the enclosure 30 of the electronic apparatus 10, the free end 22 of the antenna 20 forces the head 52 of the hook 50 to rotate outwardly in the slot 32 of the enclosure 30. The resilient mount 60 is driven to rotate with the hook 50 around the pivot shaft 82 and the coil spring 70 generates a resilient deformation. When the antenna 20 is at a position to be received in the receiving groove 36 of the enclosure 30, a resilient force generated by the coil spring 70 forces the resilient mount 60 and the hook 50 to rotate inwardly and the wedge 520 of the head 52 of the hook 50 is received in the engaging groove 220 of the antenna 20. Therefore, the antenna 20 is secured in the receiving groove 36 of the enclosure 30.

In the present electronic apparatus 10, the free end 22 of the antenna 20 is held by the hook 50 of the locking mechanism 40, which prevents the antenna 20 from releasing from the receiving groove 36 of the enclosure 30 of the electronic apparatus 10. The free end 22 of the antenna 20 is held and released by rotation of the hook 50 of the locking mechanism 40 instead of being secured by a top end of a plastic engaging block which was disclosed in the related art. Thus, the present electronic apparatus 20 is not subjected to the deterioration as mentioned in the prior art.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic apparatus comprising:

an enclosure;

an antenna having a mount end and an opposite free end, the mount end being pivotably mounted to the enclosure, the free end defining an engaging groove therein; and a locking mechanism mounted to the enclosure, the locking mechanism comprising a hook for being engaged in the engaging groove of the antenna, a resilient mount connected with the hook and capable of rotating with the hook, a supporting unit for mounting the resilient mount to the enclosure, and an elastic member for providing a resilient force when the hook and the resilient mount rotates.

2. The electronic apparatus of claim 1, wherein the hook includes a head, a neck, a body and a tail, the head being exposed outside of the enclosure, the neck being received in a slot defined in the enclosure, the body and the tail being received in a receiving cavity defined in the resilient mount, a width of the body being smaller than a width of the tail, and smaller than a width of the neck.

3. The electronic apparatus of claim 2, wherein the hook has a hatchet-shaped configuration, and the tail of the hook having a columned configuration.

4. The electronic apparatus of claim 2, wherein the hook define two indents therein, the resilient mount having two projections extending into the indents of the hook, for preventing the hook from disengaging from the receiving cavity.

5. The electronic apparatus of claim 1, wherein the resilient mount defines a space for receiving the elastic member therein, one end of the elastic member being fixed to the resilient mount, the other end of the elastic member passing though the resilient mount and being fixed to the supporting unit.

6. The electronic apparatus of claim 5, wherein the one end of the elastic member is L-shaped, the resilient mount defining an aperture and a hole communicating with the aperture, the one end of the elastic member being received in the aperture and engaged in the hole.

7. The electronic apparatus of claim 5, wherein the supporting unit includes a pivot shaft and a clasping block, the resilient mount and the elastic member being disposed around the pivot shaft, the clasping block defining a cutout for receiving the other end of the elastic member therein.

8. The electronic apparatus of claim 7, wherein the supporting unit includes a flange surround the pivot shaft, the resilient mount having a brim received in a space formed between the pivot shaft and the flange.

9. The electronic apparatus of claim 7, wherein a screw is screwed in a threaded hole defined in the pivot shaft, for preventing the resilient mounting from disengaged from the pivot shaft during rotation of the resilient mount.

10. The electronic apparatus of claim 1, wherein the elastic member is a coil spring.

11. An electronic apparatus comprising:

an enclosure defining a slot therein;

an antenna having a mount end being pivotably mounted to the enclosure, and an opposite free end; and a locking mechanism comprising a hook, a resilient mount, a supporting unit, and an elastic member, the hook having a top end for being engaged with the free end of the antenna and capable of rotating in the slot, and a bottom end connected with the resilient mount so that the resilient mount can rotate with the hook, the elastic member being connected to the resilient mount for providing a resilient force when the hook and the resilient mount rotates, the supporting unit being configured for mounting the resilient mount to the enclosure.

12. The electronic apparatus of claim 11, wherein an engaging groove is defined in the top end of the free end of the antenna and the top end of the hook having a wedge for being engaged in the engaging groove.

13. The electronic apparatus of claim 11, wherein the hook includes a head, a neck, a body and a tail, the head being exposed outside of the enclosure, the neck being received in the slot, the body and the tail being received in a receiving cavity defined in the resilient mount, a width of the body being smaller than a width of the tail, and smaller than a width of the neck.

14. The electronic apparatus of claim 13, wherein the hook has a hatchet-shaped configuration, and the tail of the hook having a columned configuration.

15. The electronic apparatus of claim 11, wherein the resilient mount defines a space for receiving the elastic member therein, one end of the elastic member being fixed to the resilient mount, the other end of the elastic member passing though the resilient mount and being fixed to the supporting unit.

16. The electronic apparatus of claim 15, wherein the one end of the elastic member is L-shaped, the resilient mount defining an aperture and a hole communicating with the aperture, the one end of the elastic member being received in the aperture and engaged in the hole.

17. The electronic apparatus of claim 16, wherein the supporting unit includes a pivot shaft and a clasping block, the resilient mount and the elastic member being disposed around the pivot shaft, the clasping block defining a cutout for receiving the other end of the elastic member therein.

* * * * *